US006378535B1

(12) United States Patent
Miyachi et al.

(10) Patent No.: US 6,378,535 B1
(45) Date of Patent: Apr. 30, 2002

(54) HOLLOW ARTICLE CLEANING APPARATUS AND HOLLOW ARTICLE CLEANING METHOD

(75) Inventors: Yoshitsugu Miyachi; Norio Mamiya, both of Hamamatsu (JP)

(73) Assignee: Yugengaisha Taiyo Seisakusho, Shizuoka-Ken (JP)

( * ) Notice: Subject to any disclaimer, the term of this patent is extended or adjusted under 35 U.S.C. 154(b) by 0 days.

(21) Appl. No.: 09/457,381

(22) Filed: Dec. 9, 1999

(51) Int. Cl.[7] ..... B08B 9/02

(52) U.S. Cl. ..... 134/102.1; 134/166 C; 134/166 R; 134/168 R; 134/199; 134/171

(58) Field of Search ..... 134/166 C, 166 R, 134/167 R, 168 R, 171, 199, 102.1, 100.1

(56) References Cited

U.S. PATENT DOCUMENTS 3,430,639 A * 3/1969 Roberts
3,448,746 A * 6/1969 Butler
3,583,413 A * 6/1971 Mertzanis
4,294,271 A * 10/1981 Intrater et al.
4,305,759 A * 12/1981 Westhoff et al.
4,325,161 A * 4/1982 Wood et al.
4,552,728 A * 11/1985 Taylor
4,703,767 A * 11/1987 Spitler et al.
4,867,186 A * 9/1989 Otsuka et al.
5,339,845 A * 8/1994 Huddas
5,419,352 A * 5/1995 Johnson
5,951,783 A * 9/1999 Kontorovich et al.

* cited by examiner

*Primary Examiner*—Frankie L. Stinson
(74) *Attorney, Agent, or Firm*—Ronald P. Kananen, Esq.; Rader, Fishman & Grauer, PLLC

(57) ABSTRACT

The hollow article cleaning apparatus comprisis a positioning means for positioning a hollow article to be cleaned in a fixed position, a plurality of cleaning medium injecting means movably disposed between an open position separated from a plurality of cleaning openings of said hollow article disposed by said positioning means and an intimate contact position that is in intimate contact with said cleaning openings for injecting a cleaning medium from said cleaning openings, a plurality of driving means for moving each of said cleaning medium injecting means between said open position and said intimate contact position, a cleaning medium supplying means for supplying said cleaning medium comprising a mixture of a cleaning liquid and a compressed air to each of said cleaning medium injecting means, and a control means for bringing each of said cleaning medium injecting means into intimate contact with said plurality of cleaning openings of said hollow article alternately for a fixed time, and for operating said driving means and said cleaning medium supplying means such that a cycle cleaning for injecting said cleaning medium into said hollow article can be carried out during said intimate contact.

1 Claim, 13 Drawing Sheets

HOLLOW ARTICLE CLEANING APPARATUS AND HOLLOW ARTICLE CLEANING METHOD

BACKGROUND OF THE INVENTION

The present invention relates to a hollow article cleaning apparatus of for reliably and effectively cleaning off foreign matter such as cutting chips attached to an interior of a hollow article, and to a hollow article cleaning method.

For example, a hollow article having a complicated shape such as an engine block or a water-cool exhaust pipe (exhaust pipe of the water jet craft or the like) in an engine is generally formed by casting and then is subjected various cutting working. At the time of the cutting working, since a large amount of cutting chips enter in the hollow article, after the hollow article is subjected to the cutting working, the hollow article is once cleaned and all the cutting chips are eliminated and then, the articles is moved to a next step (such as painting step and assembling step). Conventionally, a worker holds the articles which have been cut one at a time, and flows water inside the article using a hose to clean off the cutting chips.

However, with such a conventional cleaning manner in which the worker holds the hollow articles one at a time and cleaning by the hose, the cutting chips can not sufficiently be cleaned off depending upon its inside shape and moreover, it is extremely difficult to clean when the hollow article is large in size and heavy.

SUMMARY OF THE INVENTION

The object of the present invention is to substantially eliminate defects or drawbacks described above and to provide a hollow article cleaning apparatus and a hollow article cleaning method capable of reliably and effectively cleaning off foreign matter such as cutting chips attached to an interior of the hollow article, and to facilitate the cleaning of the large and heavy hollow article.

These and other objects can be achieved according to the present invention by providing a hollow article cleaning apparatus comprising a positioning means for positioning a hollow article to be cleaned in a fixed position, a plurality of cleaning medium injecting means movably disposed between an open position separated from a plurality of cleaning openings of said hollow article disposed by said positioning means and an intimate contact position that is in intimate contact with said cleaning openings for injecting a cleaning medium from said cleaning openings, a plurality of driving means for moving each of said cleaning medium injecting means between said open position and said intimate contact position, a cleaning medium supplying means for supplying said cleaning medium comprising a mixture of a cleaning liquid and a compressed air to each of said cleaning medium injecting means, and a control means for bringing each of said cleaning medium injecting means into intimate contact with said plurality of cleaning openings of said hollow article alternately for a fixed time, and for operating said driving means and said cleaning medium supplying means such that a cycle cleaning for injecting said cleaning medium into said hollow article can be carried out during said intimate contact.

In the preferred embodiment, a cleaning medium mixing portion for mixing said cleaning liquid and said compressed air is provided in said cleaning medium injecting means.

Further, the cleaning liquid constituting said cleaning medium is stored in a cleaning liquid reservoir, said hollow article cleaning apparatus further comprises a driving means for moving said positioning means such that said hollow article disposed by said positioning means moves vertically between an exposed position that is exposed above a liquid level of said cleaning liquid stored in said cleaning liquid reservoir and a soaked position that is soaked under said liquid level, and said control means is arranged such that after said hollow article is subjected to said cycle cleaning in said cleaning liquid in said soaked position, said hollow article is moved up to said exposed position and is again subjected to the cycle cleaning.

Also, the objects mentioned avobe can be achieved according to the present invention by providing a hollow article cleaning method wherein a cycle cleaning for injecting a cleaning medium comprising a mixture of a cleaning liquid and a compressed air from a plurality of cleaning openings of a hollow article for a fixed time alternately to clean an interior of said hollow article is first carried out in a cleaning liquid and then is carried out in the atmosphere.

According to the above structure, a cleaning medium in which a cleaning liquid and compressed air are uniformly mixed is injected into the hollow article alternately from a plurality of cleaning openings, the cleaning liquid is intensively dispersed in every corner along the inside shape of the hollow article, thereby causing the erosive action in cavitation manner, and it is possible to reliably and effectively clean off foreign matter such as cutting chips attached to an interior of the hollow article.

After the hollow article is once cleaned with the cleaning liquid, the hollow article is again cleaned in the atmosphere. Therefore, even if foreign matter such as cutting chips floating in the cleaning liquid remains in the hollow article when the hollow article is pulled out from the cleaning liquid, the remained foreign matter can reliably be cleaned off by the cycle cleaning in the atmosphere.

Further, after the hollow article to be cleaned is once disposed in the positioning means, it is unnecessary to take out until the cleaning is completed. Therefore, even when the hollow article is large and heavy, the hollow article can be effectively cleaned.

DESCRIPTION OF THE PREFERRED EMBODIMENT

Figure 1:
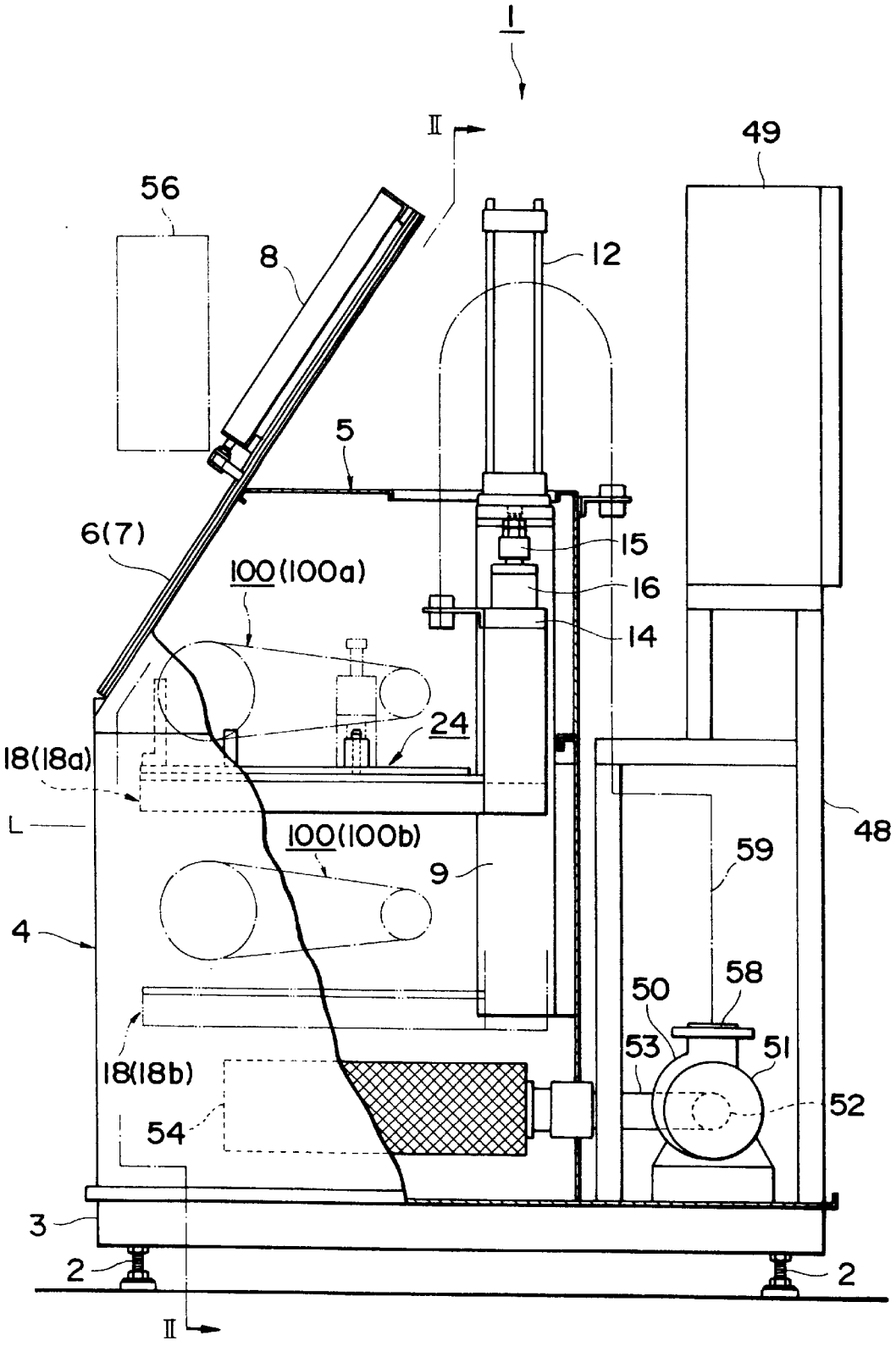
FIG. 1 is a right-hand side view showing an embodiment of a hollow article cleaning apparatus according to the present invention.
Figure 2:
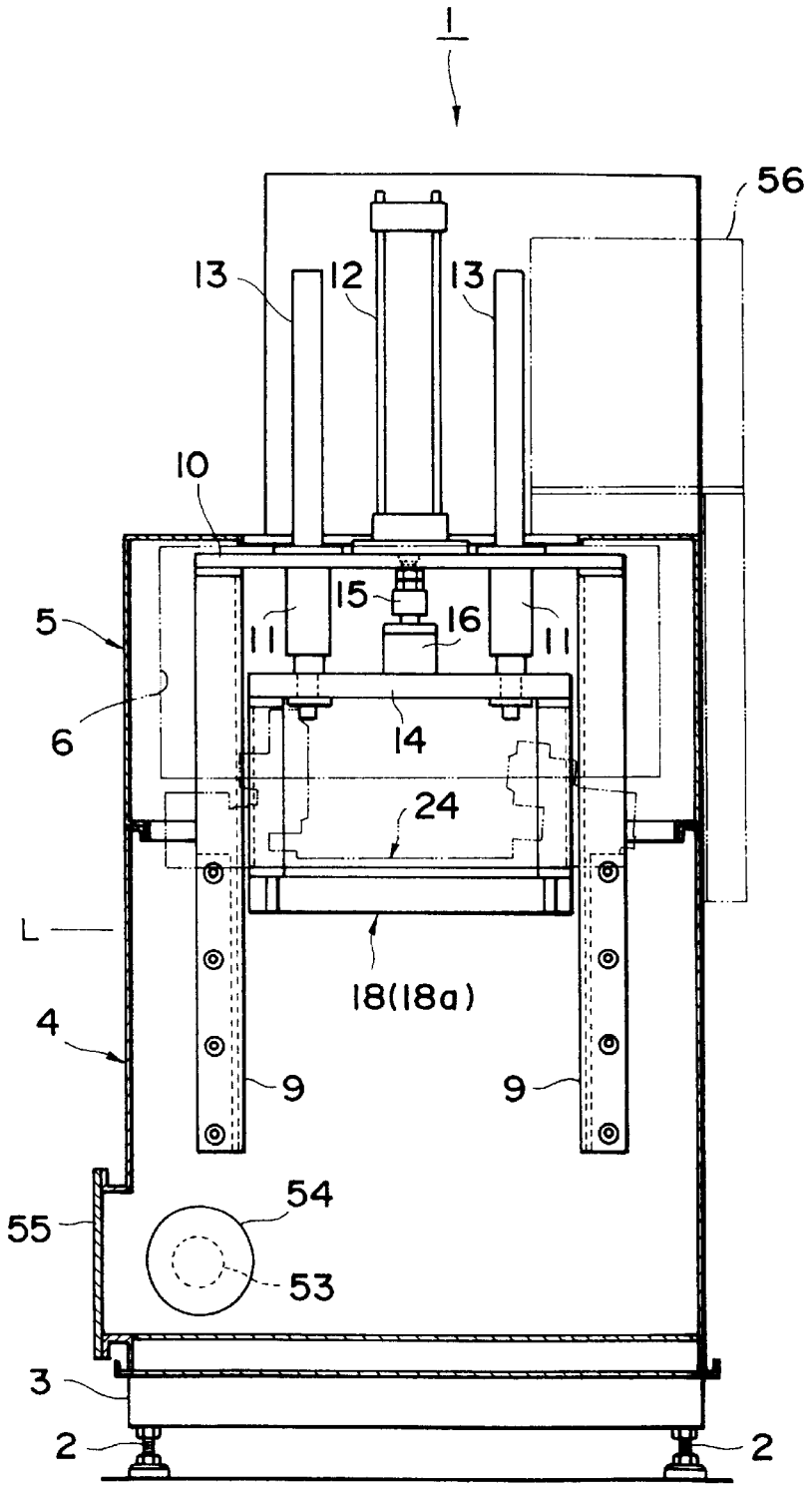
FIG. 2 is a vertical sectional view of the hollow article cleaning apparatus taken along the line II—II in FIG. 1.

An embodiment of the present invention will be described hereunder with reference to the accompanying drawings. FIG. 1 is a right-hand side view showing the embodiment of a hollow article cleaning apparatus according to the present invention, and FIG. 2 is a vertical sectional view of the hollow article cleaning apparatus taken along the line II—II in FIG. 1. This hollow article cleaning apparatus 1 is for cleaning a water-cool exhaust pipe 100 of a watercraft small engine for example, and a mixture of a cleaning liquid and compressed air is used as a cleaning medium of the apparatus 1.

Figure 14:
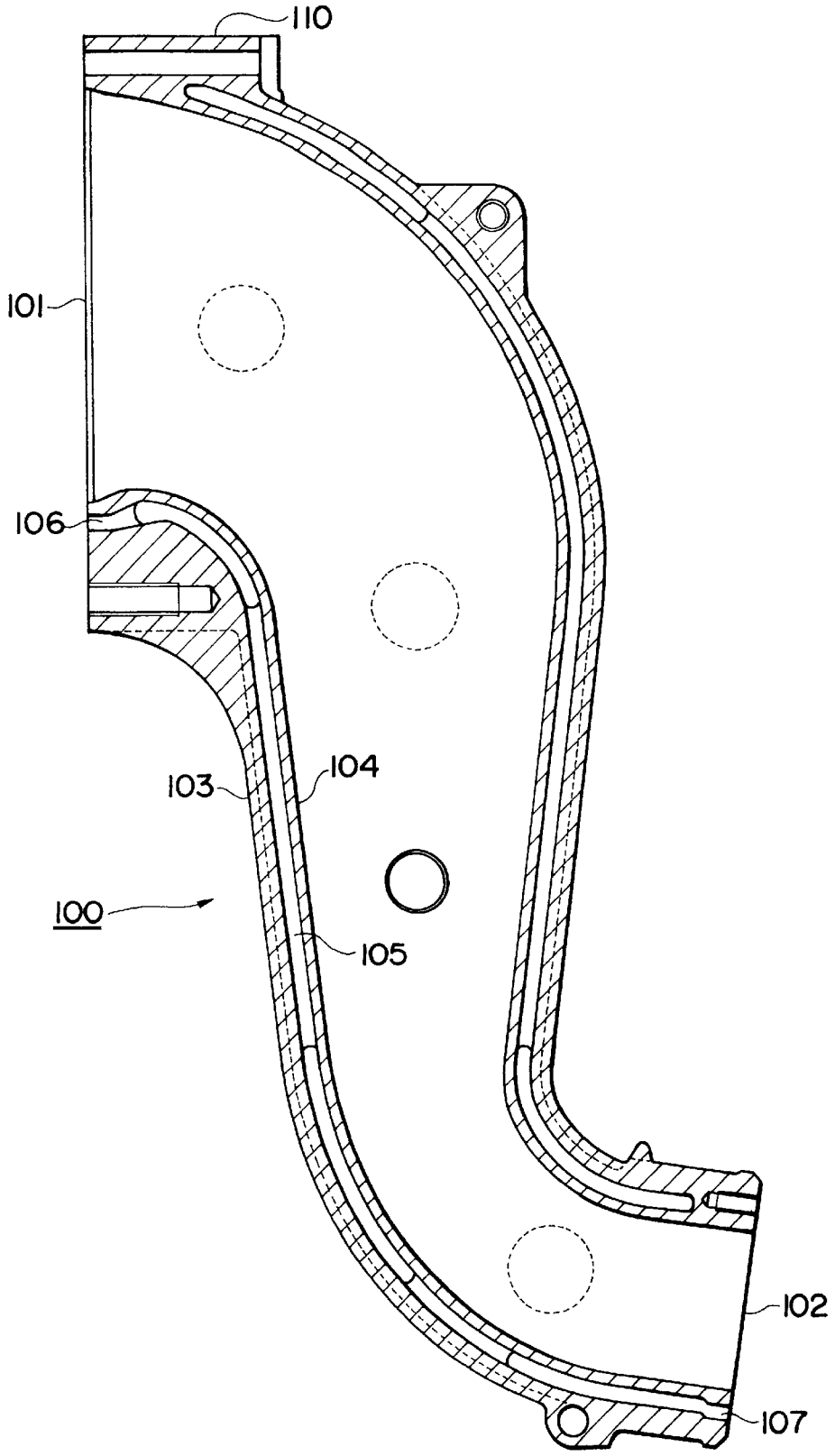
FIG. 14 is a sectional view of the water-cool exhaust pipe taken along the longitudinal direction thereof.
Figure 15:
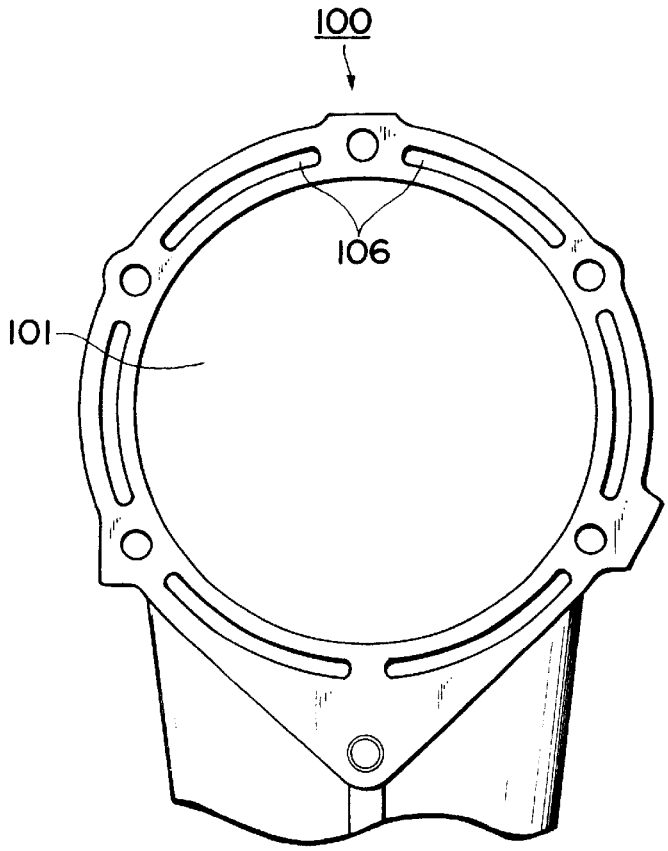
FIG. 15 is a view showing the large end of the water-cool exhaust pipe.
Figure 16:
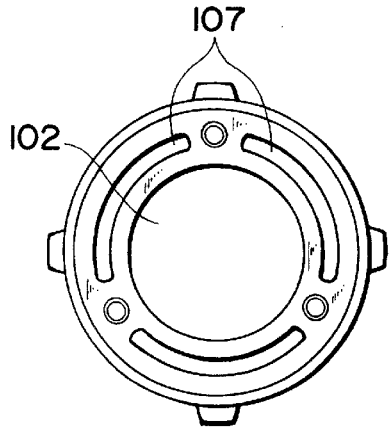
FIG. 16 is a view showing the small end of the water-cool exhaust pipe.

First, the water-cool exhaust pipe 100 is an aluminum cast formed into a substantially S-shaped double pipe configuration as shown in FIGS. 13 to 16 for example, one end thereof is a large end 101 and the other end is a small end 102. As shown in FIG. 14, a water jacket 105 which is a hollow portion is formed between an outer peripheral wall 103 and an inner peripheral wall 104 of the water-cool exhaust pipe 100. This water jacket 105 is a portion which is to be cleaned by the hollow article cleaning apparatus 1. A plurality of communication ports 106 and 107 which are in communication with the water jacket 105 are formed in end surface peripheries of the large end 101 and the small end 102, respectively. These communication ports 106 and 107 are cleaning openings of the water-cool exhaust pipe 100.

The hollow article cleaning apparatus 1, includes a base frame 3, and four corners of the base frame 3 are supported by supporting legs 2. A box-like cleaning liquid reservoir 4 which opens upward is disposed on the base frame 3, and a cleaning cover 5 is disposed on the cleaning liquid reservoir 4. A front surface of the cleaning cover 5 is formed into a slanting surface, and a cleaning window 6 is formed in the front surface. An open/close door 7 for opening and closing the cleaning window 6 is driven by a door air cylinder 8 such that the open/close door 7 slides vertically.

A vertically extending pair of left and right of hoisting/lowering rails 9 are secured to inner surfaces of a rear walls of the cleaning liquid reservoir 4 and the cleaning cover 5, and a horizontal beam-like cylinder seat 10 is secured on upper ends of the two hoisting/lowering rails 9. The cylinder seat 10 is provided with a pair of left and right guide sleeves 11 and a hoisting/lowering air cylinder 12 standing upward at a position between the guide sleeves 11.

Guide shafts 13 are slidably inserted into the left and right guide sleeves 11, and a horizontal beam-like hoisting/lowering seat 14 is secured to a lower end of each of the guide shafts 13. A lower end of a cylinder rod 15 suspended from the hoisting/lowering air cylinder 12 is connected to a central portion of the hoisting/lowering seat 14 through a connection block 16.

Figure 3:
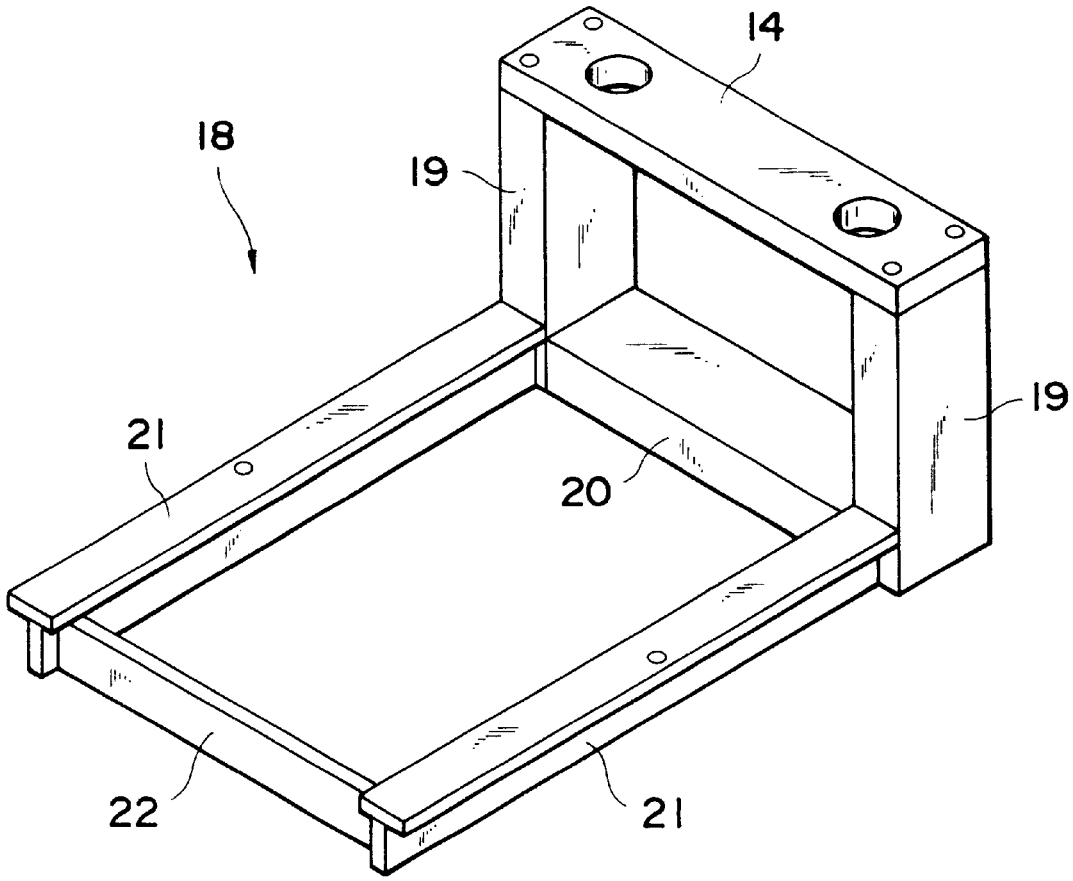
FIG. 3 is a perspective view of a hoisting/lowering frame.

Further, a hoisting/lowering frame 18 is integrally connected to a lower portion of the hoisting/lowering seat 14. As shown in FIG. 3 showing the hoisting/lowering frame 18 alone, this hoisting/lowering frame 18 comprises a pair of left and right frame columns 19 suspended from left and right ends of the hoisting/lowering seat 14, a rear bridge member 20 for connecting lower ends of the frame columns 19, a pair of horizontal arms 21 extending from lower ends of the frame columns 19 toward the front, and front bridge member 22 for connecting tip ends of the horizontal arms 21.

When the hoisting/lowering air cylinder 12 is operated, the hoisting/lowering seat 14 and the hoisting/lowering frame 18 are moved vertically together with expansion and contraction of the cylinder rod 15. As shown in FIG. 1, the hoisting/lowering frame 18 straightly moves up and down between a highest position 18*a* which is the highest portion of its vertical stroke and a lowest position 18*b* which is the lowest portion of the vertical stroke.

Figure 4:
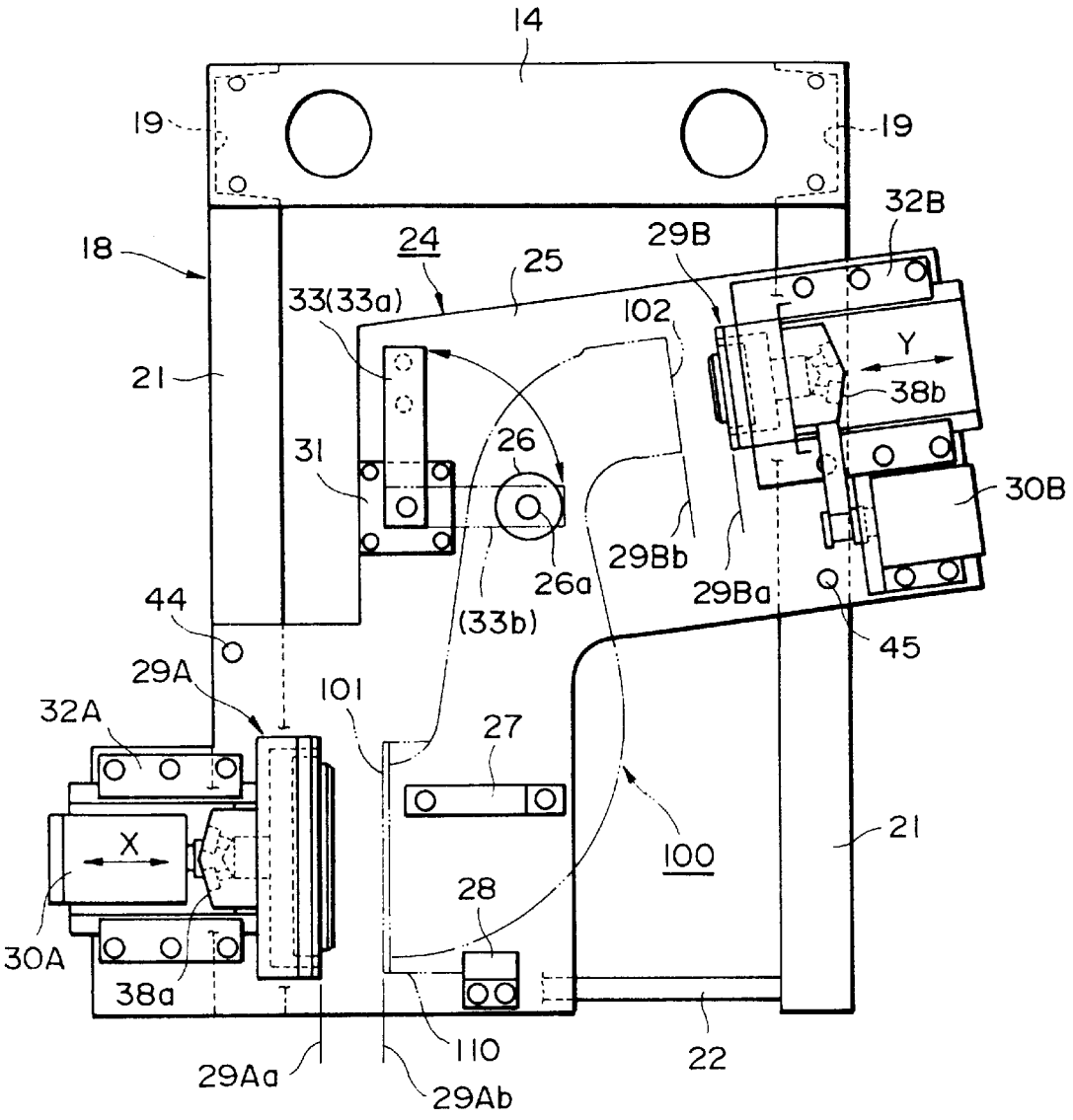
FIG. 4 is a plan view of a cleaning jig.
Figure 5:
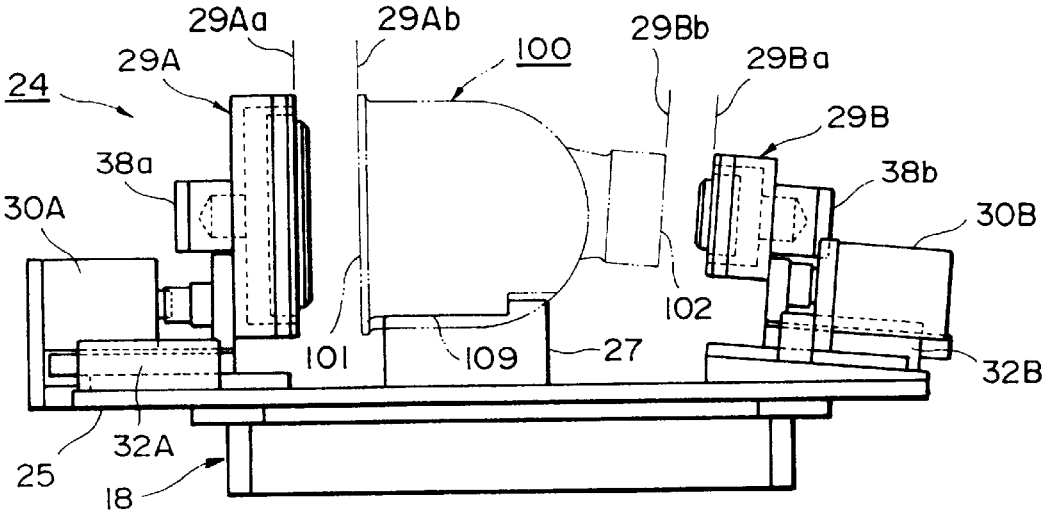
FIG. 5 is a front view of the cleaning jig.
Figure 6:
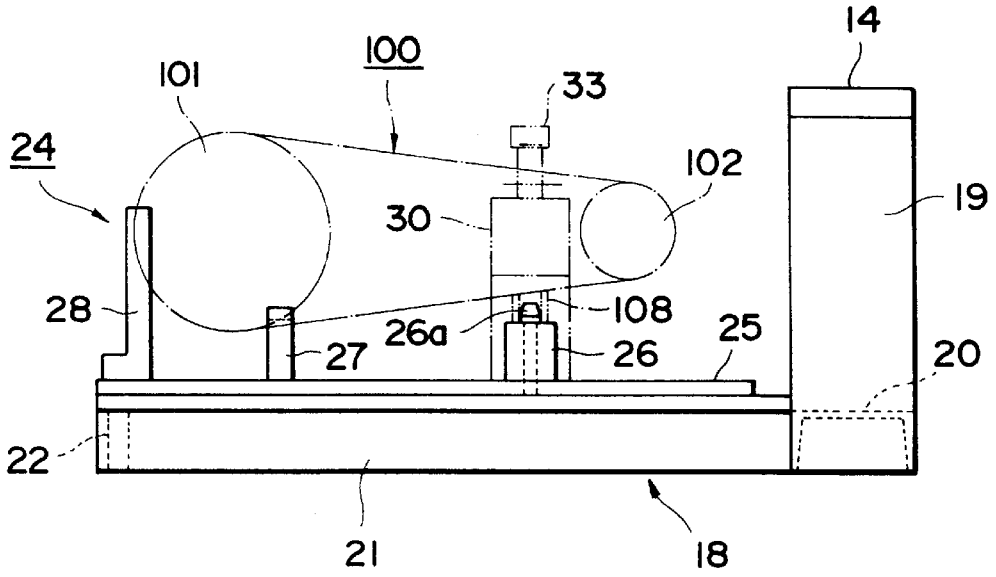
FIG. 6 is a right-hand side view of the cleaning jig.

A cleaning jig 24 is disposed on an upper surface of the hoisting/lowering frame 18. A plan view, a front view and a right side view of the cleaning jig 24 are shown in FIGS. 4 to 6, respectively. The cleaning jig 24 moves up and down between the highest position 18a and the lowest position 18*b* together with the hoisting/lowering frame 18. The cleaning jig 24 comprises a flat base plate 25 having a substantially S-shaped flat surface outline, three positioning blocks 26, 27 and 28 disposed on the base plate 25, two cleaning nozzles 29A and 29B, nozzle air cylinders 30A and 30B for driving the cleaning nozzles 29A and 29B, and a rotary clamp 31.

The height and the shape of each of the positioning blocks 26, 27 and 28 are determined such that the water-cool exhaust pipe 100 is horizontally disposed on the cleaning jig 24 in a state where the water-cool exhaust pipe 100 falls down side-ways. For example, a temperature sensor mounting boss 108 (see FIG. 13) and a working reference rib 109 of the water-cool exhaust pipe 100 are disposed on the positioning blocks 26 and 27, respectively, and a fastening boss 110 abuts against the positioning block 28 from side way. A knock pin 26*a* projecting from the positioning block 26 is fitted into a hole 111 of the temperature sensor mounting boss 108, thereby limiting a horizontal movement of the water-cool exhaust pipe 100. In this manner, each of the positioning blocks 26, 27 and 28 functions as positioning means for positioning the water-cool exhaust pipe 100 in the determined position on the cleaning jig 24.

As shown in FIG. 1, a position of the water-cool exhaust pipe 100 when the hoisting/lowering frame 18 is located at the highest position 18*a* is an exposed position 110*a*, and a position of the water-cool exhaust pipe 100 when the hoisting/lowering frame 18 is located at the lowest position 18*b* is a soaked position 100*b*.

The two cleaning nozzles 29A and 29B are provided such that they can slide in directions of arrows X and Y shown in FIG. 4, respectively. The cleaning nozzle 29A can move between an open position 29Aa separated from the large end 101 (communication port 106) of the water-cool exhaust pipe 100 disposed on the positioning blocks 26, 27 and 28 and an intimate contact position 29Ab in intimate contact with the large end 101. The cleaning nozzle 29B can move between an open position 29Ba separated from the small end 102 (communication port 107) of the water-cool exhaust pipe 100 and an intimate contact position 29Bb in intimate contact with the small end 102. These cleaning nozzles 29A and 29B function as cleaning medium injecting means.

The nozzle air cylinder 30A allows the cleaning nozzle 29A to move between the open position 29Aa and the intimate contact position 29Ab, and the nozzle air cylinder 30B allows the cleaning nozzle 29B to move between the open position 29Ba and the intimate contact position 29Bb. The nozzle air cylinders 30A and 30B are driving means of the cleaning nozzles 29A and 29B.

The rotary clamp 31 is operated by an air pressure for example, and is provided at its upper end with a stationary arm 33. The stationary arm 33 moves between an open position 33*a* that is lifted upward and a stationary position 33*b* that is lowered and rotated through 90 degree. In the stationary position 33*b,* the stationary arm 33 pushes the water-cool exhaust pipe 100 from above to secure the water-cool exhaust pipe 100 to the cleaning jig 24.

Figure 7A:
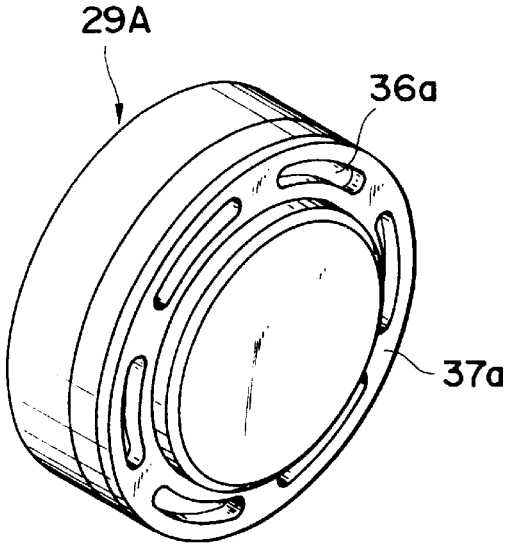
FIG. 7(A) is a perspective view of a cleaning nozzle which is brought into intimate contact with a large end side of a water-cool exhaust pipe.
Figure 7B:
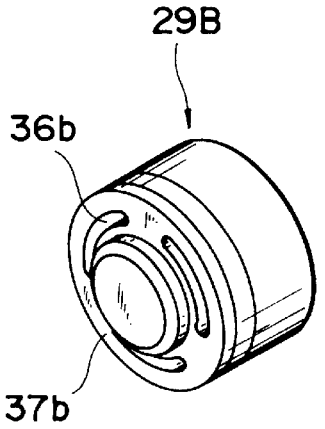
FIG. 7(B) is a perspective view of another cleaning nozzle which is brought into intimate contact with a small end side of the water-cool exhaust pipe.
Figure 8:
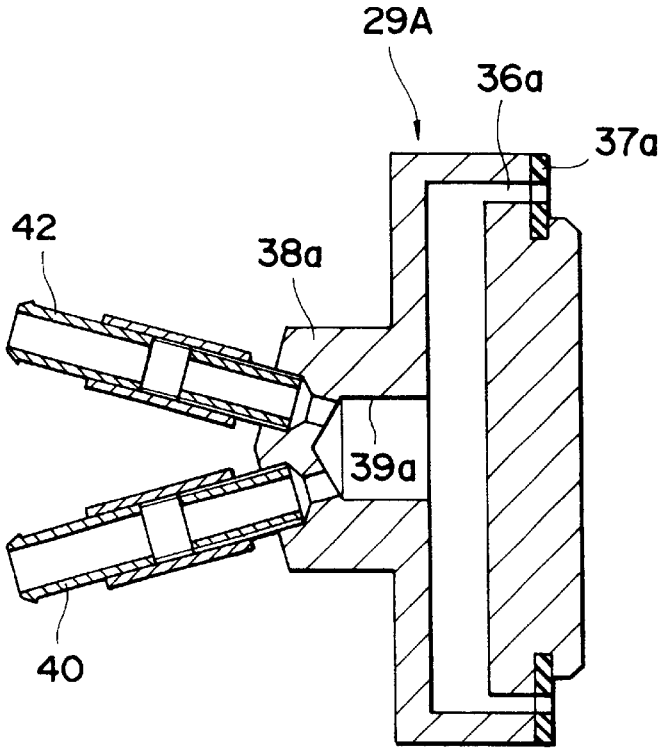
FIG. 8 is a transverse sectional view of the cleaning nozzle which is brought into intimate contact with the large end side of the water-cool exhaust pipe.
Figure 9:
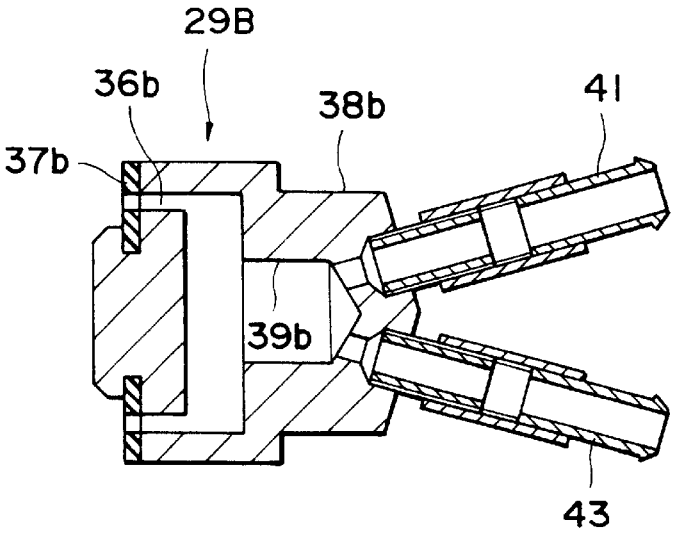
FIG. 9 is a transverse sectional view of the cleaning nozzle which is brought into intimate contact with the small end side of the water-cool exhaust pipe.

FIGS. 7(A) and 7(B) are perspective views of the cleaning nozzles 29A and 29B, respectively. FIGS. 8 and 9 are transverse sectional views of the cleaning nozzles 29A and 29B, respectively. The cleaning nozzles 29A and 29B are respectively provided with a plurality of cleaning medium discharging ports 36*a* and 36*b* which are in alignment with the communication ports 106 and 107 of the large end 101 and the small end 102 of the water-cool exhaust pipe 100. Packing materials 37*a* and 37*b* formed of soft material are provided in portions where the cleaning nozzles 29A and 29B are in intimate contact with the large end 101 and the small end 102 of the water-cool exhaust pipe 100.

The cleaning nozzles 29A and 29B are provided at their back surfaces with cleaning medium mixing portions 38*a* and 38*b*. Medium passages 39*a* and 39*b* formed in the cleanings medium mixing portions 38*a* and 38*b* are connected to the cleaning medium discharging ports 36*a* and 36*b,* respectively. The cleaning medium mixing portions 38*a* and 38*b* are respectively provided, at acute angle, with large diameter unions 40 and 41 as well as small diameter unions 42 and 43 respectively connected to the medium passages 39*a* and 39*b*.

The cleaning jig 24 is constructed in the above-described manner, and its base plate 25 is fastened and secured on the left and right horizontal arms 21 of the hoisting/lowering frame 18 through two bolts 44 and 45. As described above, the hoisting/lowering air cylinder 12 for hoisting and lowering the hoisting/lowering frame 18 together with the cleaning jig 24 functions as driving means for vertically moving the water-cool exhaust pipe 100 between the exposed position 100*a* and the soaked position 100*b*.

A supporting frame 48 is provided upright behind the cleaning liquid reservoir 4, a controller 49 (CPU and the like) is disposed on an upper portion of the supporting frame 48, and a water pump 50 is disposed on a lower portion of the supporting frame 48. The water pump 50 is a swirl pump (centrifugal pump) for example, and is driven by an electric motor 51 provided adjacent the water pump 50. A suction pipe 53 extending from a suction port 52 of the water pump 50 projects into the cleaning liquid reservoir 4, and a filter 54 is connected to a tip end of the suction pipe 53. In the cleaning liquid reservoir 4, an inspection opening 55 is provided at a position corresponding to the filter 54. A control board 56 is disposed at a position shown with a phantom line in each of FIGS. 1 and 2.

Figure 10:
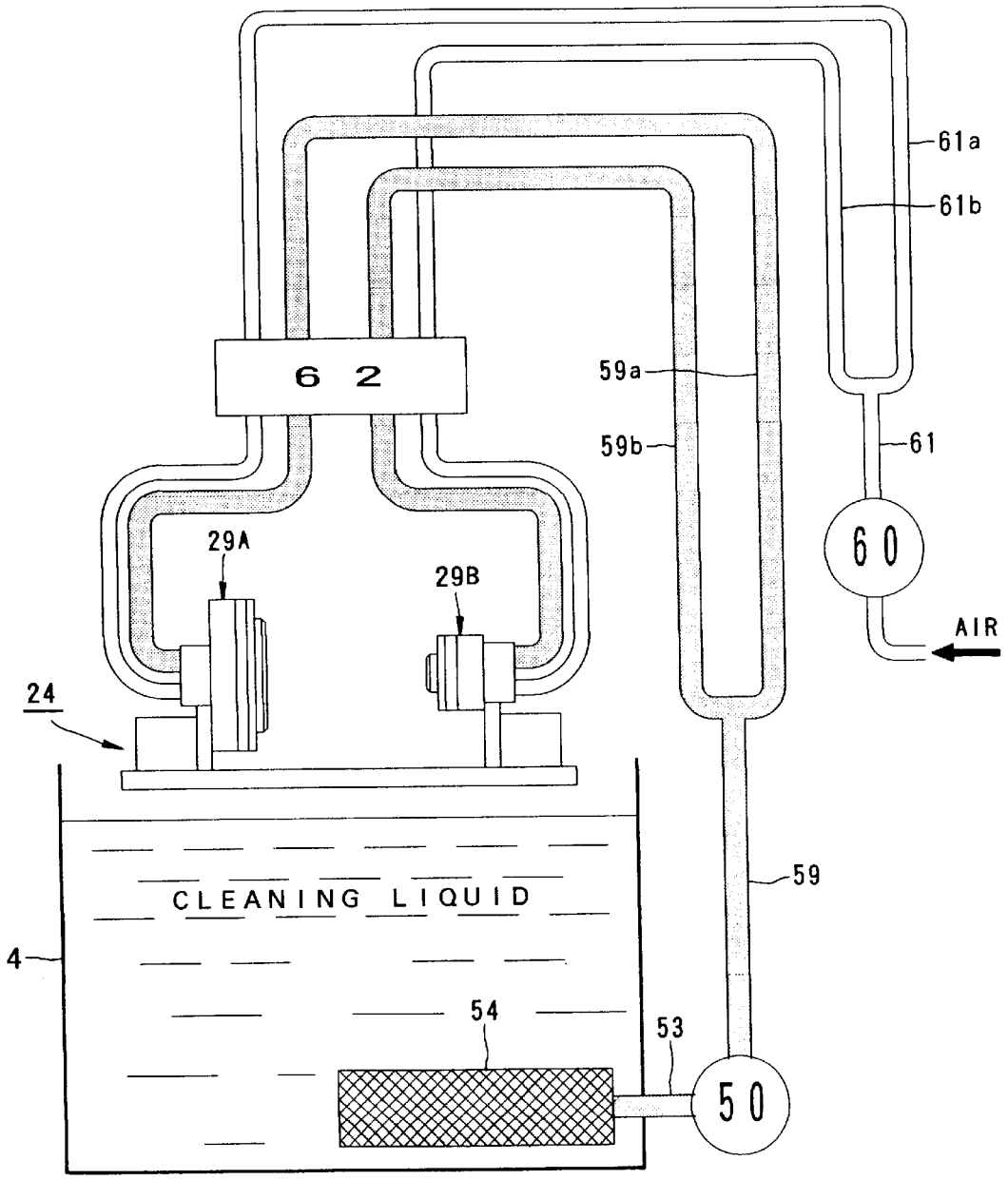
FIG. 10 is a schematic view showing a structure of cleaning medium supplying means.

Further, as shown in FIGS. 1 and 10, a cleaning liquid pipe 59 extending from a discharge port 58 of the water pump 50 is bifurcated into two cleaning liquid branch pipes 59*a* and 59*b*. One of the cleaning liquid branch pipes 59*a* is connected to the large diameter union 40 of the cleaning nozzle 29A, and the other cleaning liquid branch pipe 59*b* is connected to the large diameter union 41 of the cleaning nozzle 29B. On the other hand, a compressed air pipe 61 extending from an air pump 60 (see FIG. 10) provided outside the hollow article cleaning apparatus 1 is bifurcated into two compressed air branch pipes 61*a* and 61*b*. One of the compressed air branch pipes 61*a* is connected to the small diameter union 42 of the cleaning nozzle 29A, and the other compressed air branch pipe 61*b* is connected to the small diameter union 43 of the cleaning nozzle 29B.

A switching valve 62 (see FIG. 10) is connected to intermediate portions of the two cleaning liquid branch pipes 59*a,* 59*b* and the two compressed air branch pipes 61*a* , 61*b*. The switching valve 62 has three operating modes, i.e., an opening mode A for opening only the cleaning liquid branch pipe 59*a* and the compressed air branch pipe 61*a* which are connected to the cleaning nozzle 29A, an opening mode B for opening only the cleaning liquid branch pipe 59*b* and the compressed air branch pipe 61*b* which are connected to the cleaning nozzle 29B, and a closing mode C for closing both the cleaning liquid branch pipes 59*a* , 59*b* and the compressed air branch pipes 61*a* , 61*b*.

The water pump 50, the cleaning liquid pipe 59, the cleaning liquid branch pipes 59*a,* 59*b,* the air pump 60, the compressed air pipe 61, the compressed air branch pipes 61*a,* 61*b,* the switching valve 62, and the cleaning medium mixing portions 38*a,* 38*b* of the cleaning nozzles 29A, 29B are members constituting cleaning medium supplying means. The controller 49 functions as control means.

The hollow article cleaning apparatus 1 is constructed as described above, and cleaning liquid is stored in the cleaning liquid reservoir 4 of the hollow article cleaning apparatus 1. As the cleaning liquid, water or warm water is used except when oil or medication is cleaned. A height of liquid level L of the cleaning liquid is previously adjusted such that the water-cool exhaust pipe 100 (exposed position 100*a*) disposed on the cleaning jig 24 comes higher than the liquid level L when the hoisting/lowering frame 18 is in the highest position 18*a,* and the water-cool exhaust pipe 100 (exposed position 110*a*) comes lower than the liquid level L when the hoisting/lowering frame 18 is in the lowest position 18*b*.

A discharging pressure of the water pump 50 is set to some kg/cm$^2$ (e.g., 3 kg/cm$^2$), and a discharging pressure of the air pump 60 is set to less than 10 kg/cm$^2$ (e.g., 6 to 7 kg/cm$^2$). In the present embodiment, the capacity of the cleaning liquid reservoir 4 is set to 300 liters for example, and the discharging volume of the water pump 50 is set to 125 liters/minute for example.

When the water-cool exhaust pipe 100 is cleaned by the hollow article cleaning apparatus 1, a door open/close switch (not shown) of the control board 56 is first operated to allow the door air cylinder 8 to open the open/close door 7 of he cleaning cover 5, the water-cool exhaust pipe 100 is inserted from the opened cleaning window 6 and disposed on the positioning blocks 26, 27 and 28 of the cleaning jig 24. Next, a stationary switch (not shown) of the control board 56 is operated to move the stationary arm 33 of the rotary clamp 31 from the open position 33*a* to the stationary position 33*b,* thereby securing the water-cool exhaust pipe 100 on the cleaning jig 24. Then, the door open/close switch is operated to close the open/close door 7, thereby turning ON a cleaning starting switch (not shown) of the control board 56.

By turning the cleaning starting switch ON, the controller 49 operates the hoisting/lowering air cylinder 12, the nozzle air cylinders 30A, 30B and the switching valve 62, and brings the cleaning nozzles 29A and 29B into intimate contact with the large end 101 (communication port 106) and the small end 102 (communication port 107) of the water-cool exhaust pipe 100 alternately for a fixed time. During the intimate contact, a cycle cleaning for injecting the cleaning medium into the water jacket 105 of the water-cool exhaust pipe 100 is carried out. This cycle cleaning is carried out in the cleaning liquid stored in the cleaning liquid reservoir 4 and then carried out in the atmosphere. The cycle cleaning in the cleaning liquid will be explained in the order of steps.

[Cycle Cleaning in the Cleaning Liquid]

(First Cleaning Step)

First, after the cleaning starting switch is turned ON, the controller 49 drives the hoisting/lowering air cylinder 12 to lower the hoisting/lowering frame 18 together with the cleaning jig 24 from the highest position 18*a* to the lowest position 18*b*. With this movement, the water-cool exhaust pipe 100 secured to the cleaning jig 24 is lowered from the exposed position 100*a* that is exposed above the liquid level L to the soaked position 100*b* that is soaked under the liquid level L. At that time, both the cleaning nozzles 29A and 29B are disposed in the open positions 29Aa and 29Ba, and the switching valve 62 is in the closing mode C.

(Second Cleaning Step)

Next, the controller 49 drives the nozzle air cylinder 30B to allow the cleaning nozzle 29B to slide from the open position 29Ba to the intimate contact position 29Bb, thereby bringing the cleaning nozzle 29B into intimate contact with the small end 102 (communication port 107) of the water-cool exhaust pipe 100 and at the same time, the controller 49 switches the switching valve 62 into the opening mode B. With this operation, the cleaning liquid supplied from the water pump 50 through the cleaning liquid pipe 59 and the cleaning liquid branch pipe 59*b,* and the compressed air supplied from the air pump 60 through the compressed air pipe 61 and the compressed air branch pipe 61*b* are supplied to the cleaning medium mixing portion 38*b* of the cleaning nozzle 29B, and the cleaning liquid and the compressed air are mixed in the medium passage 39*b* to form the cleaning medium, the cleaning medium is discharged from the cleaning medium discharging port 36*b* of the cleaning nozzle 29B and the cleaning medium flows into the water jacket 105 from the communication port 107 of the water-cool exhaust pipe 100 on the side of the small end 102.

The cleaning medium flowing into the water jacket 105 scours foreign matter such as cutting chips remaining in the water jacket 105 from the small end 102 toward the large end 101, and flows out from the communication port 106 of the water-cool exhaust pipe 100 on the side of the large end 101 together with the foreign matter and returns into the cleaning liquid reservoir 4. The cleaning nozzle 29B is brought into intimate contact with the small end 102 of the water-cool exhaust pipe 100 for a fixed time, i.e., for 30 seconds. During this intimate contact, the cleaning from the side of the small end 102 is carried out. Only the cleaning liquid in the cleaning medium flowing out from the communication port 106 substantially returns into the cleaning liquid reservoir 4, and the compressed air in the cleaning medium is dissipated into the atmosphere.

(Third Cleaning Step)

Then, the controller 49 switches the switching valve 62 from the opening mode B to the closing mode C, thereby stopping the supply of the cleaning liquid and the compressed air once, drives the nozzle air cylinder 30B to allow the cleaning nozzle 29B to slide from the intimate contact position 29Bb to the open position 29Ba, thereby completing the cleaning from the side of the small end 102.

(Fourth Cleaning Step)

Next, the controller 49 drives the nozzle air cylinder 30A to allow the cleaning nozzle 29A to slide from the open position 29Aa to the intimate contact position 29Ab, thereby bringing the cleaning nozzle 29A into intimate contact with the large end 101 (communication port 106) of the water-cool exhaust pipe 100 and at the same time, the controller 49 switches the switching valve 62 from the closing mode C to the opening mode A. With this operation, the cleaning liquid supplied from the water pump 50 through the cleaning liquid pipe 59 and the cleaning liquid branch pipe 59*a,* and the compressed air supplied from the air pump 60 through the compressed air pipe 61 and the compressed air branch pipe 61*a* are supplied to the cleaning medium mixing portion 38*a* of the cleaning nozzle 29A, and the cleaning liquid and the compressed air are mixed in the medium passage 39*a* to form the cleaning medium, the cleaning medium is discharged from the cleaning medium discharging port 36*a* of the cleaning nozzle 29A and the cleaning medium flows into the water jacket 105 from the communication port 106 of the water-cool exhaust pipe 100 on the side of the large end 101.

The cleaning medium flowing into the water jacket 105 scours foreign matter such as cutting chips remaining in the water jacket 105 from the large end 101 toward the small end 102 which is opposite in the second cleaning step, and flows out from the communication port 107 at the side of the small end 102 together with the foreign matter and returns into the cleaning liquid reservoir 4 (only the cleaning liquid). The cleaning nozzle 29A is brought into intimate contact with the large end 101 for a fixed time (e.g., for 30 seconds). During this intimate contact, the cleaning from the side of the large end 101 is carried out.

(Fifth Cleaning Step)

Thereafter, the controller 49 returns the switching valve 62 from the opening mode A to the closing mode C to stop the supply of the cleaning liquid and the compressed air, and drives the nozzle air cylinder 30A to allow the cleaning nozzle 29A to slide from the intimate contact position 29Ab to the opening position 29Aa, thereby completing the cleaning from the side of the large end 101. Then, the first to fifth cleaning steps are completed, and the cycle cleaning in the cleaning liquid is completed.

[Cycle Cleaning in the Atmosphere]

After the above-described cycle cleaning in the cleaning liquid is completed, the controller 49 drives the hoisting/lowering air cylinder 12 to hoist the hoisting/lowering frame 18 together with the cleaning jig 24 from the lowest position 18*b* to the highest position 18*a* so that the water-cool exhaust pipe 100 is placed on the exposed position 100*a* that is exposed above the liquid level L of the cleaning liquid. Then, a cycle cleaning which is the same as the above-described first to fifth cleaning steps is repeated in the atmosphere. At that time, a time period during which the cleaning nozzles 29A and 29B are brought into intimate contact with the large end 101 and the small end 102 of the water-cool exhaust pipe 100 and the cleaning medium is injected may be shorter than the intimate contact time (30 seconds) in the cycle cleaning in the cleaning liquid, and is set to about 10 seconds for example.

If the two cycle cleanings in the cleaning liquid and the atmosphere are completed in the above-described manner, the door open/close switch is operated to open the open/close door 7 of the cleaning cover 5. The stationary switch is operated to move the stationary arm 33 of the rotary clamp 31 from the stationary position 33*b* to the open position 33*a,* and the water-cool exhaust pipe 100 is removed from the cleaning jig 24. With the above steps, all the cleaning steps are completed.

According to the hollow article cleaning apparatus 1 constructed as described above, the cleaning medium comprising the mixed cleaning liquid and compressed air is supplied into the water jacket 105 alternately from the large end 101 (communication port 106) and the small end 102 (communication port 107) of the water-cool exhaust pipe 100, the cleaning liquid is intensively dispersed in every corner along the inside shape of the water jacket 105 by the expansion effect of the compressed air, the erosive action in cavitation manner is caused by the influence of the compressed air so that the foreign matter such as cutting chips attached to the inner surface of the water jacket 105 is peeled off and therefore, it is possible to reliably and effectively clean off the foreign matter.

Further, since the cleaning liquid and the compressed air constituting the cleaning medium are mixed in the cleaning medium mixing portions 38*a* and 38*b* of the cleaning nozzle 29A and 29B immediately before they are injected into the water jacket 105 of the water-cool exhaust pipe 100, the cleaning liquid and the compressed air should not be separated while they are supplied to the water jacket 105, and the cleaning liquid and the compressed air are uniformly mixed. Therefore, the dispersion state of the cleaning liquid in the water jacket 105 is enhanced, and a high cleaning effect can be obtained.

Furthermore, according to the hollow article cleaning apparatus 1 and the hollow article cleaning method of the invention, after the water-cool exhaust pipe 100 which was once subjected to the cycle cleaning in the cleaning liquid is pulled out from the cleaning liquid, the water-cool exhaust pipe 100 is again subjected the cycle cleaning in the atmosphere. Therefore, even if foreign matter such as cutting chips floating in the cleaning liquid remains in the water jacket 105 when the water-cool exhaust pipe 100 is pulled out from the cleaning liquid, the remained foreign matter can reliably be cleaned off by the cycle cleaning in the atmosphere.

Further, after the water-cool exhaust pipe 100 is once disposed in the cleaning jig 24, it is unnecessary to take out the water-cool exhaust pipe 100 until the cleaning is completed. Therefore, the large and heavy water-cool exhaust pipe 100 can be effectively cleaned and many water-cool exhaust pipes 100 can be easily cleaned in a short time.

Figure 11:
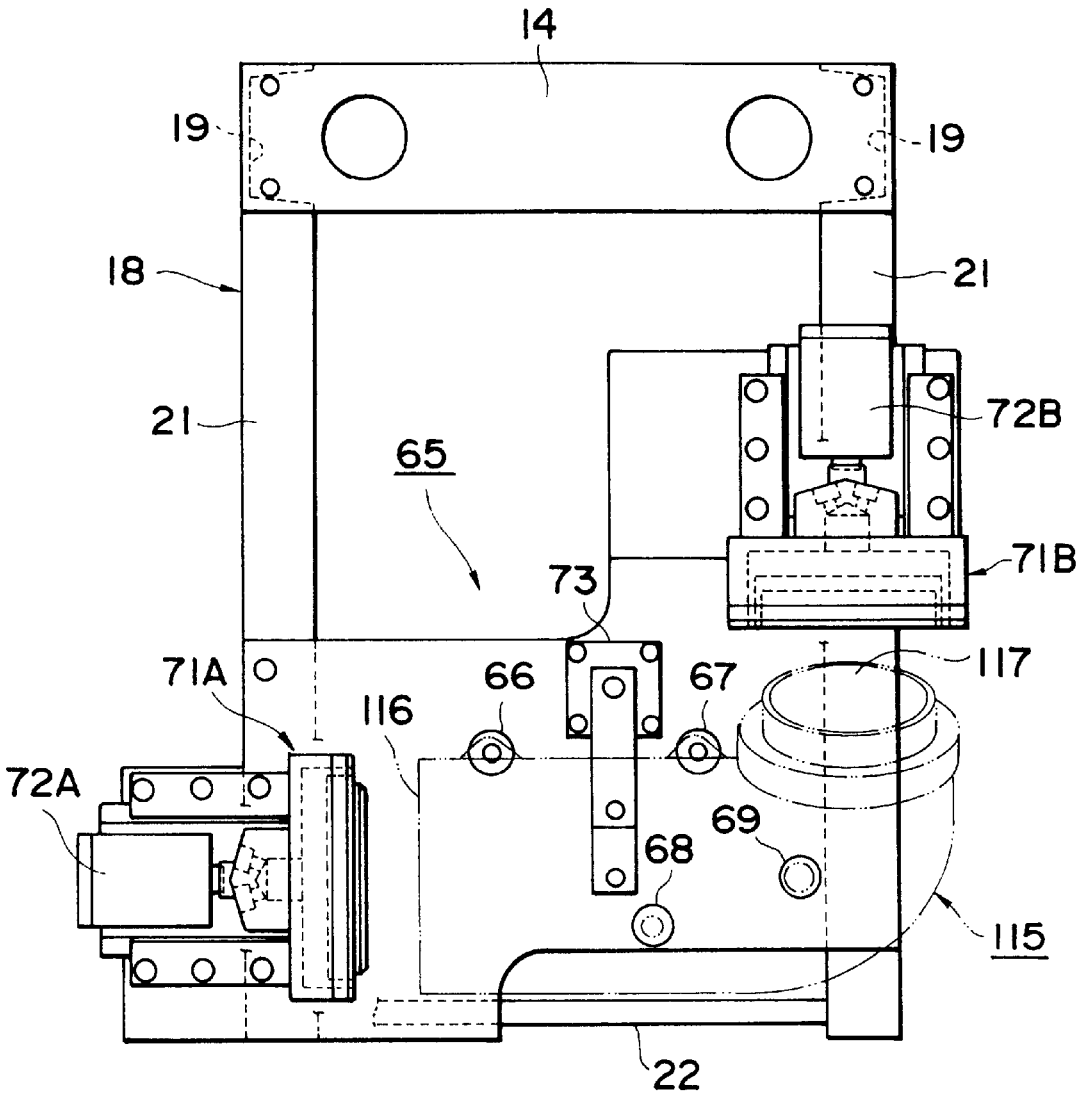
FIG. 11 is a plan view showing another embodiment of the cleaning jig.
Figure 12:
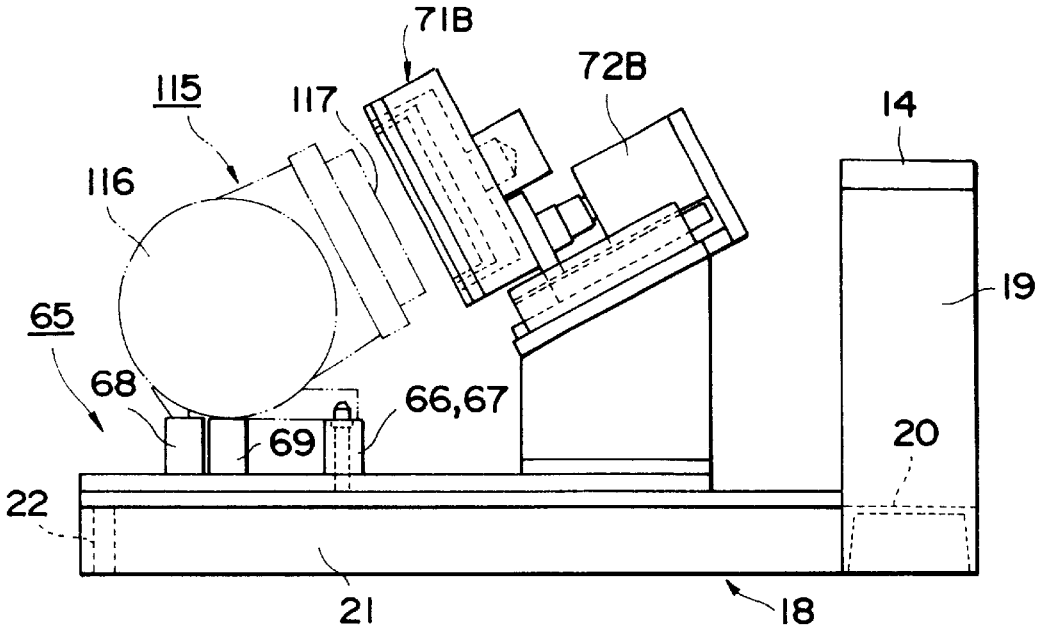
FIG. 12 is a right-hand side view showing another embodiment of the cleaning jig.
Figure 13:
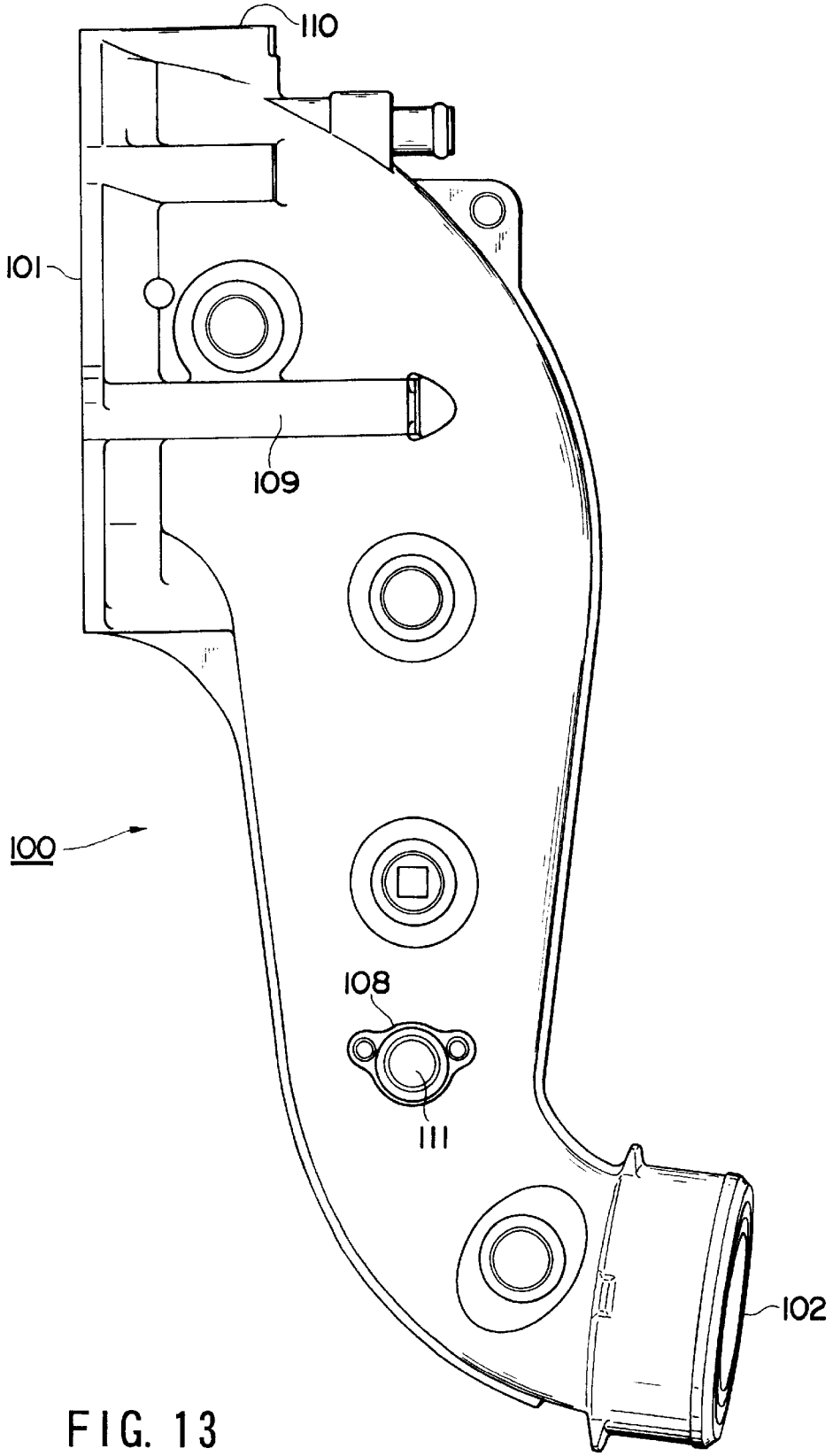
FIG. 13 is a plan view of the water-cool exhaust pipe.

Meanwhile, FIGS. 11 and 12 are plan view and right-hand side view of a cleaning jig 65 constructed such that a water-cool exhaust chamber 115 connected to the above-described water-cool exhaust pipe 100 on the side of the large end 101 is cleaned. This water-cool exhaust chamber 115 is also an aluminum cast formed into a substantially L-shaped double pipe configuration, and its one end is a large end 116 and the other end is a small end 117, and a communication port (not shown) which is in communication with a water jacket (not shown) formed between an inner peripheral wall and an outer peripheral wall of the chamber 115 is provided.

The cleaning jig 65 is provided with four positioning blocks 66, 67, 68 and 69, two cleaning nozzles 71A and 71B, nozzle air cylinders 72A and 72B ,which drive two cleaning nozzles 71A and 72B, and a rotary clamp 73. Structures and operational manners of these members are the same as the above-described cleaning jig 24. Like the water-cool exhaust pipe 100, in this water-cool exhaust chamber 115 secured to the cleaning jig 65, the cleaning nozzles 71A and 71B are brought into intimate contact with the large end 116 and the small end 117 alternately for a fixed time, the cleaning medium is injected and the chamber 115 is cleaned.

If the structures of the cleaning jigs 24 and 65 and the program of the controller 49 are slightly changed, it is possible to dispose other hollow articles such as an engine block or intake manifold in addition to the water-cool exhaust pipe 100 or the water-cool exhaust chamber 115, and to effectively clean such hollow articles.

Also, it is to be noted that the present invention is not limited to the described embodiment and many other changes and modifications may be made without departing from the scopes of the appended claims.

What is claimed is:

1. A hollow article cleaning apparatus comprising:

a positioning means for positioning a hollow article to be cleaned in a fixed position:

a plurality of cleaning medium injecting means movably disposed between an open position separated from a plurality of cleaning openings of said hollow article disposed by said positioning means and an intimate contact position that is in intimate contact with said cleaning openings for injecting a cleaning medium from said cleaning openings;

a plurality of driving means for moving each of said cleaning medium injecting means between said open position and said intimate contact position;

a cleaning medium supplying means for supplying said cleaning medium comprising a mixture of a cleaning liquid and a compressed air to each of said cleaning medium injecting means;

a control means for bringing each of said cleaning medium injecting means into intimate contact with said plurality of cleaning openings of said hollow article alternately for a fixed time, and for operating said driving means and said cleaning medium supplying means such that a cycle cleaning for injecting said cleaning medium into said hollow article can be carried out during said intimate contact; and a cleaning medium mixing portion provided in said cleaning medium injecting means for mixing said cleaning liquid and said compressed air, said cleaning liquid constituting said cleaning medium is stored in a cleaning liquid reservoir, said hollow article cleaning apparatus further comprises a driving means for moving said positioning means such that said hollow article disposed by said positioning means moves vertically between an exposed position that is exposed above a liquid level of said cleaning liquid stored in said cleaning liquid reservoir and a soaked position that is soaked under said liquid level, and said control means is arranged such that after said hollow article is subjected to said cycle cleaning in said cleaning liquid in said soaked position, said hollow article is moved up to said exposed position and is again subjected to the cycle cleaning.

* * * * *